US008235147B1

(12) United States Patent
Seegmiller

(10) Patent No.: US 8,235,147 B1
(45) Date of Patent: Aug. 7, 2012

(54) APPARATUS AND METHOD FOR INSTALLING GROUND ANCHORING SYSTEMS

(76) Inventor: Ben L. Seegmiller, Salt Lake City, UT (US)

( * ) Notice: Subject to any disclaimer, the term of this patent is extended or adjusted under 35 U.S.C. 154(b) by 0 days.

(21) Appl. No.: 13/178,325

(22) Filed: Jul. 7, 2011

(51) Int. Cl.
*E21B 7/28* (2006.01)
*E21B 10/32* (2006.01)

(52) U.S. Cl. ..... 175/273; 175/272; 175/286

(58) Field of Classification Search ..... 175/272, 175/273, 279, 286, 280, 292
See application file for complete search history.

(56) References Cited

U.S. PATENT DOCUMENTS 1,720,950 A * 7/1929 Edwards ..... 175/273
1,794,735 A * 3/1931 Santiago ..... 175/273
1,828,750 A * 10/1931 Raymond ..... 175/273
1,856,579 A * 5/1932 Mitchell et al. ..... 175/273
2,879,038 A 3/1959 Johnson
4,036,026 A 7/1977 Asayama
4,046,205 A 9/1977 Asayama
5,219,246 A 6/1993 Coutts et al.
5,934,394 A 8/1999 Fareham
7,686,103 B2 3/2010 Pile

* cited by examiner

*Primary Examiner* — Giovanna Wright
(74) *Attorney, Agent, or Firm* — Morriss O'Bryant Compagni, PC

(57) ABSTRACT

An apparatus and method for forming a borehole in an earthen formation includes a side cutting device comprised of a cam assembly that includes at least one groove therein for selective extension and retraction of a laterally extending cutting element. Rotation of the side cutting device in a first direction causes the cutting element to be in a first retracted position so that a borehole having a first diameter can be formed. Rotation of the side cutting device in a second direction causes the cutting element to be in a second extended position. Rotation and retraction of the side cutting device when the cutting element is in the second extended position allows the side cutting device to create a larger borehole diameter in a down hole location.

19 Claims, 8 Drawing Sheets

APPARATUS AND METHOD FOR INSTALLING GROUND ANCHORING SYSTEMS

BACKGROUND OF THE INVENTION

1. Field of the Invention

The present invention relates generally to ground anchoring systems, and more specifically, to methods and devices used to drill boreholes in rock strata or other earthen formations for ground anchoring systems.

2. State of the Art

There are various situations where it is critical for safety reasons to maintain the integrity of rock formations or to provide secure anchoring of rock bolts and the like. Such situations may be where earth has been excavated that create a steep inclined wall, tunnelling or in underground mining where the ceiling or roof needs to be secured to prevent a cave-in or even large chunks of rock from falling on workers. In addition, there are situations where the ground is used as an anchoring point to which a cable or other structure in tension must be attached. In such situations, a borehole is drilled and an anchoring system is installed.

In underground mining, a system of roof bolts is used to secure the roof and walls of a mine shaft so that they are self-supporting. According to U.S. law, all underground coal mine entries must be roof bolted. In order to increase the speed by which the roof is bolted, roof bolting machines have been developed. Currently, such roof bolters are hydraulically driven miner-mounted bolting rigs that can be maneuvered in a mine opening and that includes one or more drilling stations for installing roof bolts.

A roof bolting machine works by drilling directly into the rock strata with a rock boring drill bit and inserting either conventional bolts, resin roof bolts or cement grouted roof bolts. These machines use bidirectional type drills that are capable of drilling holes into the rock strata of a depth from about four feet to twelve feet. In addition, the machines are used to insert and, in some applications, tighten and tension the roof bolts that are inserted into the predrilled boreholes.

More modern roof bolting machines are automated to remove the risk of having the operator be exposed to falling rock while the roof bolting procedure is being performed. Such roof bolting machines are operated via remote control from a safer position located away from the unsupported roof area. They use the same technique, however, of drilling a borehole, inserting a resin or cement grout cartridge, inserting a roof bolt and spinning the roof bolt to mix the resin or grout until the resin or grout hardens. The roof bolts may be installed in an untensioned or tensioned state, depending on the particular bolting method being employed.

There are primarily two types of roof bolts used in underground mining. In both instances, boreholes are drilled into the roof and/or walls. Long steel rods are inserted into the boreholes and retained in one of two ways. Point anchor bolts or expansion shell bolts are one type of roof bolt. The anchor bolt is typically between about ¾ to 1 inch in diameter and between about 3 and 12 feet in length. An expansion shell is positioned at the end of the bolt that is inserted into the hole. As the bolt is tightened, the expansion shell expands and causes the bolt to be retained within the hole. These types of bolts are considered temporary because corrosion will reduce the life span of such roof bolts. In addition, because they are only secured by the expansion shell, a layer of closely jointed or soft rock at the expansion shell could allow the expansion shell and the roof bolt to move relative to the hole. This can create a dangerous environment, especially in areas where such rock formations are prevalent.

As such, all underground coal mines in the U.S. use some form of resin or cement grouted roof bolts. One such resin grouted roof bolt is comprised of a length of rebar. The rebar is of a similar size to the anchor bolt previously described, but is not provided with an expansion shell. Rather, after drilling the hole, an elongate tube (cartridge) of resin is inserted into the hole. The rebar is then installed after the resin and spun by the installation drill. This opens the resin cartridge and mixes the resin components. The proximal end of the rebar includes a head that engages a roof plate when fully inserted into the borehole. For tensioning applications, the rebar may include an exposed threaded end for receiving a threaded nut that can be tightened against a roof plate, which in turn is pressed against the roof thus holding the rock strata together. Such tensioning applications usually require a point anchor at the distal end of the rebar. In such applications, an expansion shell system may be used in combination with a resin or cement grout to provide a point anchor at the distal end and to allow tensioning of the roof bolt. In other untensioned applications, the rebar is simply inserted with the resin or cement grout and spun until the resin or grout cures. Such resin or cement grouted rebar is considered a more permanent form of roof support with a potential lifespan in excess of twenty years, since the resin or cement grout help prevent corrosion of the rebar. Long sections of cable have also been employed in place of conventional roof bolts. They are installed in a similar manner to conventional resin or cement grouted roof bolts, but may have significantly longer lengths. Even with the resin or cement hardened around the roof bolt, in some underground mines where the rock strata is unstable, or mostly comprised of closely jointed rock or soft rock, the roof bolt can be relatively easily dislodged from the borehole in which it has been inserted. This may occur even when the bolt is tensioned during the installation process or later and without warning when the result could create a potentially serious safety threat. In such environments, current methods of roof bolt installation do not provide any way to increase the load bearing capability of each roof bolt. In other words, if a roof bolt is imbedded in soft or highly fragmented rock formations, there may be no way to know if the roof bolt is going to hold and there is nothing that can help prevent the roof bolt from failing.

As such there is a significant need in the art to provide a method for installing ground anchors, such as roof bolts, that ensures that the ground anchor will be adequately secured to the ground even in conditions of closely jointed or soft rock. There is also a need to provide such a method for installing ground anchors that does not add any significant amount of time to the anchor installation process. In addition, there is a need in the art to provide a method for installing a ground anchor that is easy to follow and consistently produces the desired result of ensuring that the ground anchor will properly perform even in ground conditions that are not conducive for such anchoring system installations.

SUMMARY OF THE INVENTION

Accordingly, the present invention provides an apparatus and method of using the apparatus to drill holes into earthen formations that creates a wider diameter down hole than the diameter of the hole at the point of entry. In other words, the apparatus of the present invention is capable of creating a hole having two different diameters, with a wider diameter portion being down hole of a narrower diameter portion. The apparatus is configured to work with conventional drill bits used for drilling rock formations, such as when installing rock or roof bolts in underground mining situations, but could be adapted for other situations, such as when anchoring tension cables to rock formations.

In one embodiment an apparatus for forming a borehole in an earthen formation is comprised of a drill bit having a distal cutting end and a proximal end configured for coupling. A side cutting apparatus is comprised of a first end configured for coupling to the drill bit and a second end configured for coupling to a drill stem. A first cam structure has at least one groove formed therein with the groove being laterally radially offset relative to the first cam structure. At least one cutting element having a base portion is at least partially disposed within the groove and includes a cutting portion depending from the base portion that radially extends from the first cam structure. A second cam structure is positioned adjacent to the first cam structure for retaining the at least one cutting element within the groove. An inner sleeve is rotatably coupled to one of the first cam structure and the second cam structure and fixedly coupled to the other of the first cam structure and the second cam structure. Rotation of the drilling stem in a first direction causes the at least one cutting element to be in a first retracted position relative to the outer sleeve and rotation of the drilling stem in a second direction causes the first cam structure to rotate relative to the second cam structure to thereby force the at least one cutting element to move along the groove to a second extended position.

In another embodiment, the first cam assembly includes a pair of grooves, each groove being laterally radially offset relative to the first cam structure and in an opposite direction to the other groove.

In another embodiment, the base portion of the cutting element is comprised of one of a pin, an arcuate plate and a semispherical ball.

In still another embodiment, the second cam structure defines at least one recess in a face thereof that faces the first cam structure. At least a portion of the base portion of the cutting element is positioned within the recess. The recess has a width substantially similar to a width of the base portion inserted therein and a length sufficient to allow the base portion to translate within the recess as the base portion moves along the groove.

In yet another embodiment, an outer sleeve is positioned over an interface between the first cam structure and the second cam structure and has at least one aperture formed in a side wall thereof. The cutting portion of the cutting element extends through the aperture at least when in the second extended position.

In another embodiment, the first and second cam structures are in a fixed relation to each other. The second cam structure includes a corresponding groove to the groove in the first cam structure. The outer sleeve is fixedly coupled relative to one of the first cam structure and the second cam structure so as to rotate therewith.

In still another embodiment, the outer sleeve is integrally formed with the first cam structure and the second cam structure fits at least partially within the outer sleeve.

The present invention also includes a method for forming a borehole in an earthen formation comprising providing a drill bit assembly in accordance with the principles of the present invention. First, the drill bit assembly is rotated in a first direction to drill a borehole in an earthen formation with the at least one cutting element in a first retracted position. Next, the drill bit assembly is rotated in a second direction to rotate the first cam structure relative to the second cam structure, thereby forcing the cutting element to move along the groove to a second extended position. As the drill bit assembly is rotating in the second direction, the drill bit is retracted a certain distance from the borehole to form an enlarge borehole portion in a down hole location. Rotation of the drill bit assembly back in the first direction causes the cutting element to retract to the first retracted position. The drill bit assembly can them be removed from the borehole. This creates an enlarged diameter portion in the borehole at a down hole location.

BRIEF DESCRIPTION OF THE DRAWINGS

The foregoing summary, as well as the following detailed description of the illustrated embodiments is better understood when read in conjunction with the appended drawings. For the purpose of illustrating the invention, there is shown in the drawings several exemplary embodiments which illustrate what is currently considered to be the best mode for carrying out the invention, it being understood, however, that the invention is not limited to the specific methods and instruments disclosed. In the drawings.

DETAILED DESCRIPTION OF THE ILLUSTRATED EMBODIMENTS

Figure 1:
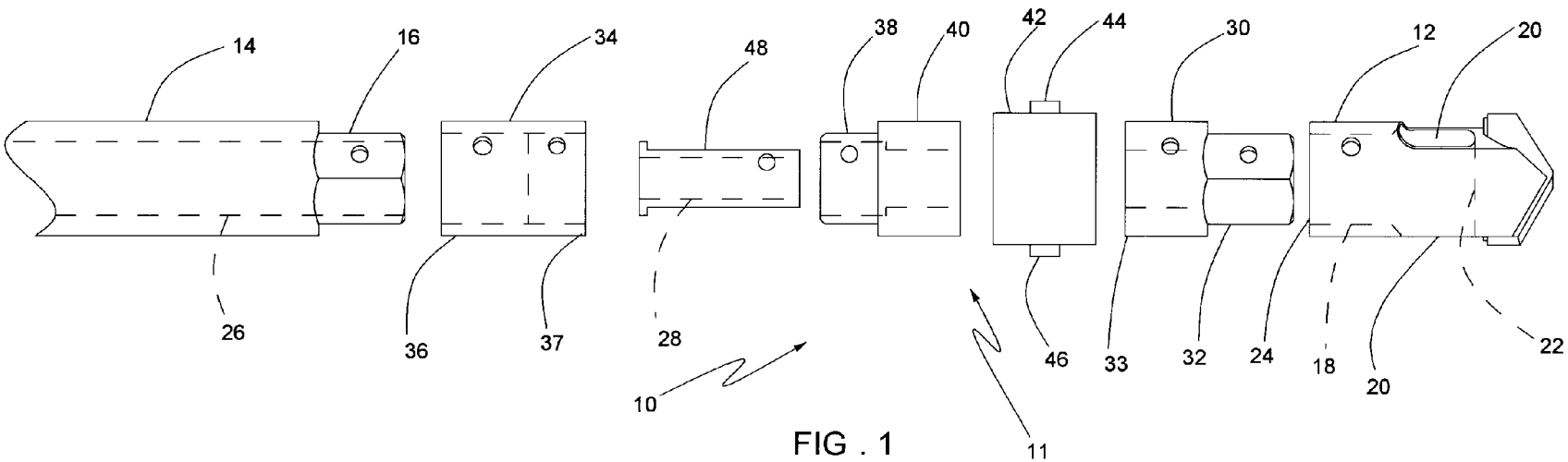
FIG. 1 is an exploded side view of a first embodiment of a drill bit and a drill bit adapter in accordance with the principles of the present invention.

FIG. 1 is side view of a first embodiment of a drill assembly, generally indicated at 10, configured for enlarging a borehole diameter in a down hole position according to the principles of the present invention. The drill assembly 10 is configured to work with a conventional rock drilling bit 12 and drill stem 14. In a conventional configuration, the drill bit 12 is directly coupled to the drill rod or stem 14 (commonly referred to as the "drill steel") with the hexagonal end 16 of the drill stem inserted into the corresponding hexagonal opening in the drill bit 12. The drill bit 12 is provided with transversely extending side vents 20 that extends transversely through a central portion 22 of the drill bit 12 and are in fluid communication with a longitudinal bore 18 that extends from an open proximal end 24 of the drill bit 12 to the side vents 20. The drill stem 14 also includes a longitudinally extending bore 26 that when coupled to the bit 12 provides a continuous duct through which debris from a drilling process can be vacuum pulled through the vent 20 along the bore 26 and to a collection bin in the drilling machine (not shown) in order to reduce the amount of drilling dust that exits the borehole being drilled with the bit 12.

The drill assembly 10 is configured with a longitudinally extending bore 28 that when the parts are assembled that extends from the bit 12 through the drill stem 14 so as to allow the aforementioned debris to be drawn through the drill assembly 10 during the drilling process as previously described. The drill assembly 10 includes a side cutter assembly 11 that includes a first cam component 30 configured for attachment to the drill bit 12. Thus, the distal end 32 of the component 30 is configured to fit within the proximal end 24 of the bit 22. The proximal end 33 is provided with a first set of cam features therein. A drill stem attachment component 34 has a proximal end 36 configured for attachment to the hexagonal end of the drill stem 16 and a distal end 37 configured for attachment to a proximal end 38 of a second cam component 40. The first and second cam components form camming surfaces (not visible). An exterior sleeve 42 that holds a pair of laterally extendable cutters 44 and 46 is configured to fit over the first and second cam components 30 and 40. An internal sleeve 48 is configured to fit within and abut against the second cam component and be fixedly coupled to the first cam component 30. This allows the first cam component 30 to rotate to a certain degree relative to the second cam component 40. In other words, the second cam component can swivel about the internal sleeve 48 in either direction to a limited degree. In operation, as will be described in more detail herein, engagement of the cam features of the cam component 30 and 40 along with relative rotation of the first cam component 30 relative to the second cam component 40 will cause the cutters 44 and 46 to extend or retract laterally relative to the sleeve 42 depending on the direction of rotation of the bit 12 relative to the stem 14.

Figure 2:
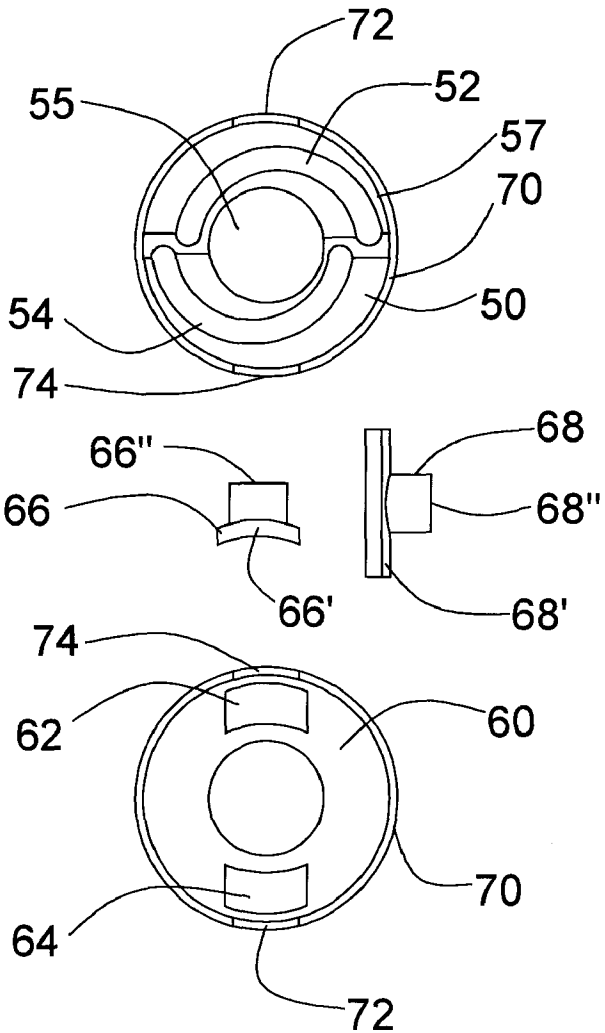
FIG. 2 is a top and bottom view, respectively, of one embodiment of a pair of cam components in accordance with the principles of the present invention.

As will be discussed throughout, the cam components and cutters may have various configurations. For example, as shown in FIG. 2, a first cam component 50 is provided with first and second cam grooves 52 and 54. The cam grooves 52 and 54 are oppositely oriented on opposite halves of the cam component 50. The cam grooves are radially offset so that each groove 52 and 54 has a beginning point and end point that are at different radial positions with each groove 52 and 54 having a radius along the center of the groove that is approximately equal to a radius of the cam component 50 at a position midway between the central aperture 55 and the outer circumferential surface 57. In other words, the mean radius of each groove is approximately equal to the radius at the midpoint between the aperture 55 and the outer surface 57. In addition, each groove 52 and 54 has a semi-circular contour. Each groove 52 and 54 is transversely offset relative to a diameter of the cam component and in opposite directions. As such, they are not mirror images of one another, but rather 180 degree rotations of each other. In the second cam component 60, first and second, oppositely oriented recesses 62 and 64 are formed therein. First and second cutters 66 and 68, each include a base portion 66' and 68' and a cutter portion 66" and 68" extending therefrom. The base portions 66' and 68" are configured with one side to fit in a respective cam groove and the other side to fit within a respective one of the recess 62 and 64 when the first and second cam components 50 and 60 are brought together. The sleeve 70 that surrounds the cam components 50 and 60 is provided with apertures 72 and 74 sized to receive a respective one of the cutters 66 and 68. The outer sleeve 70 is configured to be fixedly coupled to the cam component 60, but rotatable relative to the cam component 50. As the sleeve 70 rotates, the engagement of the bases 66' and 68' of the cutters 66 and 68 with the grooves 52 and 54, respectively, causes the cutters to be laterally displaced relative to the sleeve 70 as the bases 66' and 68' slide along the grooves 52 and 54 to cause the cutters 66 and 68 to protrude from the sleeve 70 or retract within the sleeve 70. In so doing, the base portions 66' and 68' of the cutters 66 and 68 slide linearly within the recesses 62 and 64 that are sized to fit the base portions 66' and 68'. It should be noted that while the various embodiments shown and described herein include a pair of cam grooves and a corresponding pair of cutters arranged directly transverse to one another, the side cutting apparatus of the present invention could be formed with a single groove and a single side cutter or multiple cutters arranged in multiple cam assemblies that are stacked one on top of the other in accordance with the principles of the present invention.

Figure 3:
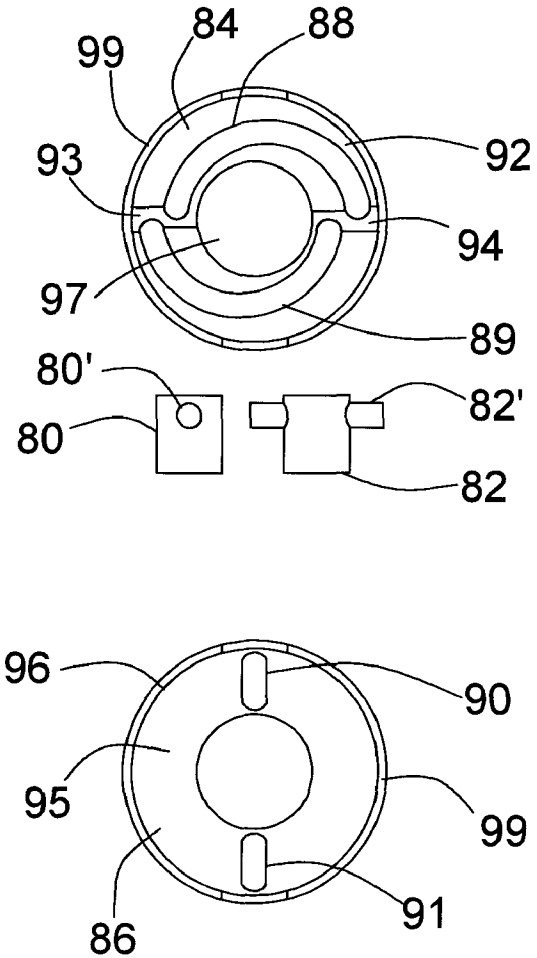
FIG. 3 is a top and bottom view, respectively, of another embodiment of a pair of cam components in accordance with the principles of the present invention.

FIG. 3 illustrates a similar configuration to that of FIG. 2 with differently configured side cutters 80 and 82 and cam components 84 and 86. The cutters 80 and 82 are provided with laterally extending cylindrical arms or pins 80' and 82' that are sized to engage a respective cam groove 88 or 89 on one side and recesses 90 and 91 formed in cam component 86 on the other side. The face 92 of the cam component 84 is provided with raised portions 93 and 94 to abut against the surface 95 of cam component 86. This creates lateral stability between the components 84 and 86 as they rotate and slide relative to each other in order to cause lateral displacement of the cutting elements 80 and 82 relative to the sleeve 96 as described with reference to FIG. 2. Because of the engagement of the pins 80' and 82' with a respective groove 88 and 89, the cam components 84 and 86 can rotate relative to each other a limited amount. In this embodiment, the relative rotation is slightly less than 90 degrees. However, over that angular rotation, the pins 80' and 82' can move from near the center aperture 97 to the outside edge of the cam component 84. This will cause lateral displacement of the cutters 80 and 82 relative to the sleeve 99 of the distance between the radius of the component 84 to the center of the groove 88 at its point nearest the center of the component 84 and the radius of the component 84 to the center of the groove 88 at its point farthest from the center of the component 84. Given that the diameter of the component 88 may be only 1.25 inches (3.2 mm) for a roof bolt application, the lateral displacement of each cutter 80 and 82 may be about 2 to 4 mm, resulting in an increase in diameter of the borehole of 4 to 8 mm.

Figure 5:
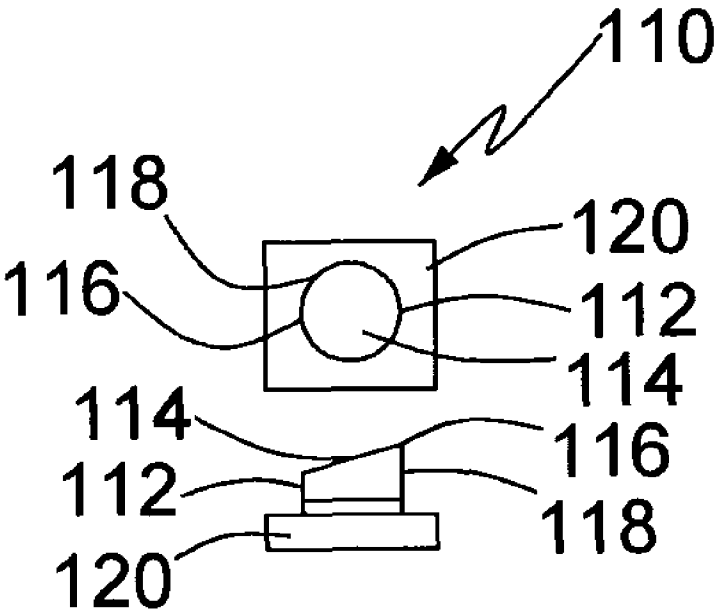
FIG. 5 is a side and front view of another embodiment of a cutting element in accordance with the principles of the present invention.
Figure 4:
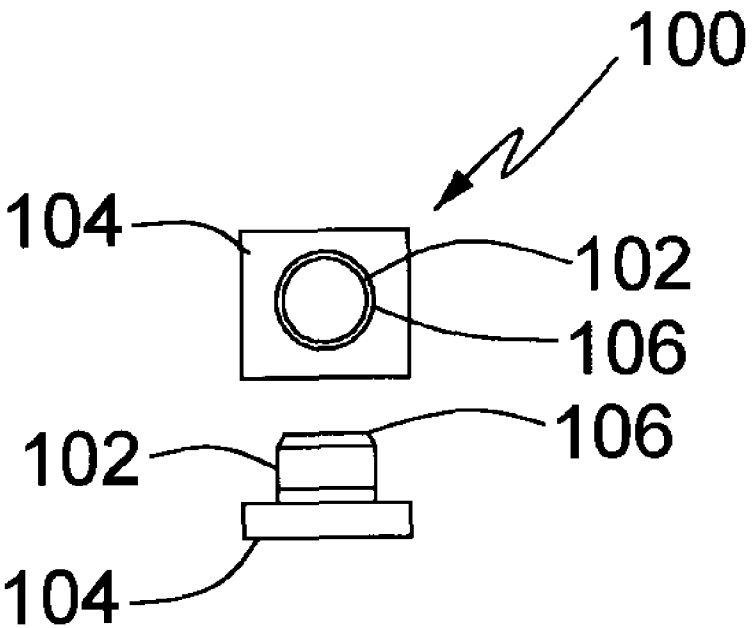
FIG. 4 is a side and front view of one embodiment of a cutting element in accordance with the principles of the present invention.

As illustrated in FIGS. 4 and 5, the individual cutting elements may have different configurations and may be in a form similar to diamond cutting elements used on earth boring drill bits, such as rotary drag bits. The cutting element 100 is predominantly comprised of a diamond cutting structure 102 attached to a base structure 104. The leading or exposed edge 106 of the diamond cutting structure is beveled to increase the integrity of the cutting structure and to help prevent breakage of the cutting element at this edge. The cutting element 110 shown in FIG. 5 is similarly configured with a diamond cutting structure 112, but the cutting structure includes a tapered top surface 114 to provide a sharpened leading edge 116 defining an acute angle between the surface 114 and the front side 118 of the cutting structure 112. Again, the cutting structure is attached to the base 120. When positioned within a cutting apparatus according to the principles of the present invention, the leading edge 116 is oriented so that when the cutting structure 112 is extended and positioned for cutting, the leading edge 116 is oriented toward the direction of rotation so that the cutting is achieved by this sharpened leading edge 116. The cutting structure 112 is bonded to the base 120 by methods known in the art. The cutting structure 112 may also be formed from tungsten carbide or other materials known in the art for their cutting properties.

Figure 6:
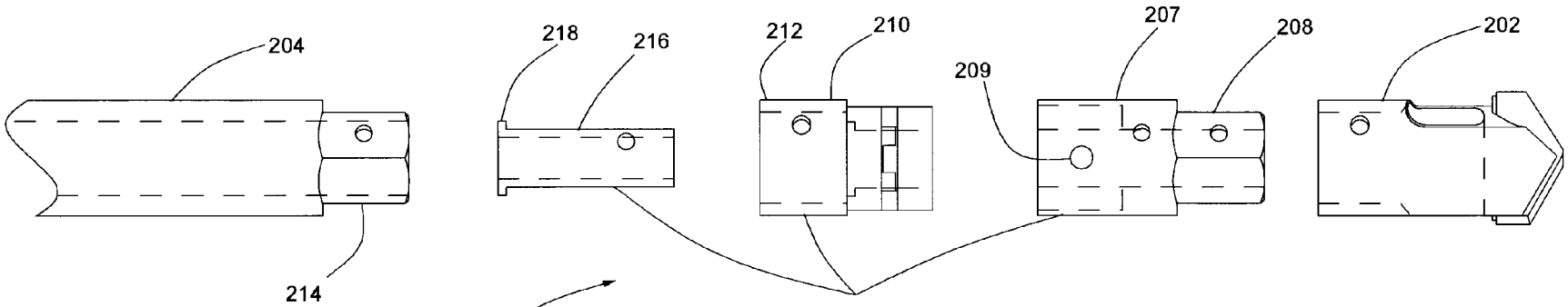
FIG. 6 is an exploded side view of a third embodiment of a drill bit and a drill bit adapter in accordance with the principles of the present invention.

FIG. 6 illustrates another embodiment of an earth boring drill assembly 200 in accordance with the principles of the present invention. The drill assembly 200 includes a standard drill bit 202 and standard drill stem 204. Interposed between the drill bit 202 and drill stem 204 is a selectively actuated bore enlarging cutting device 206 that forms an adapter between the drill bit 202 and the drill stem 204. The cutting device 206 is comprised of an outer housing component 207 configured at one end 208 for attachment to the drill bit 202, a cam assembly 210 having one end 212 configured for mating with the distal end 214 of the drill stem 204 and an inner sleeve 216 having a retaining rim 218 at one end to abut against an inside surface of the cam assembly 210. The inner sleeve 216 has a length sufficient to pass through the cam assembly 210 and be attached to the outer housing 207. The cam assembly can thus freely rotate a limited degree within the outer housing 207 in either direction.

Figure 6A:
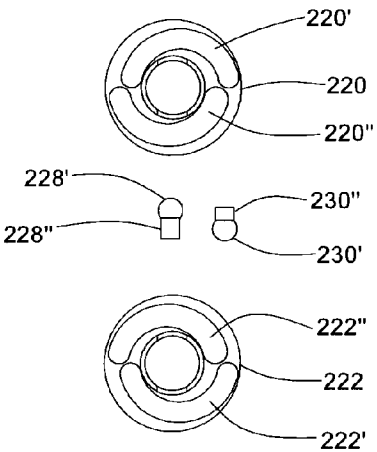
FIG. 6A is a top view of the components of a cam mechanism illustrated in FIG. 6.

As shown in FIG. 6A, the cam assembly 210 is comprised of a first cam member 220 and a second cam member 222 that are configured with corresponding cam grooves 220', 220", 222' and 222". The center portions 224 and 226 of each cam member 220 and 220 are provided with respective mating raised and recessed surfaces so that when the two cam members 220 and 222 are brought together, their relative rotational orientation is maintained. In this way, groove 222' will be positioned directly above groove 220' and groove 222" will be positioned directly above groove 220". Thus, the respective grooves work in tandem to guide a cutting element therein. The cutting elements 228 and 230 are each comprised of a semispherical base portion 228' and 230' and an attached cylindrical cutting element 228" and 230". The cutting elements each protrude through an aperture 209 in the outer sleeve member 207. As the sleeve 207 rotates relative to the cam assembly 210, the base portions 228' and 230' slide or roll along their respective groove set 220' and 220" or 222' and 222". This causes the cutting portions 228" and 230" to extend or retract relative to the sleeve 207.

Figure 7B:
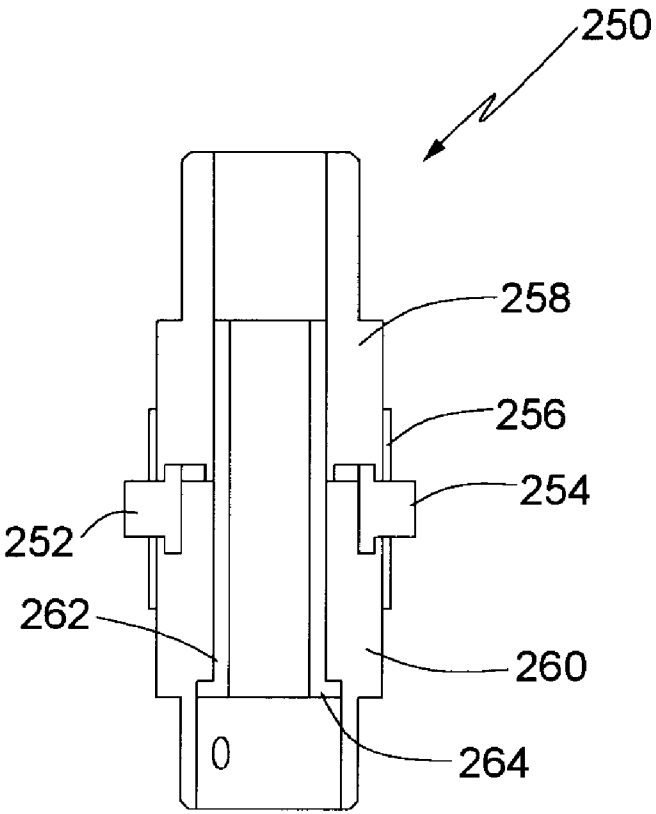
FIGS. 7A and 7B are cross-sectional side views of yet another embodiment of a side cutting adapter in accordance with the principles of the present invention.
Figure 7A:
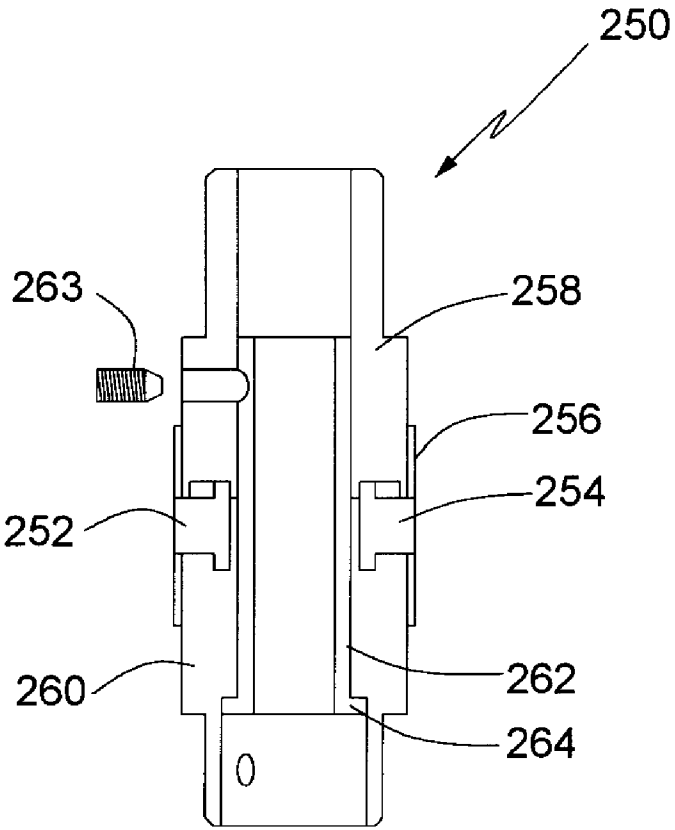

As shown in FIGS. 7A and 7B, a side cutting bit adapter, generally indicated at 250, is capable of extending and retracting laterally extendable side cutters 252 and 254 from a retracted position shown in FIG. 7A where the outermost surface of each side cutter 252 and 254 is substantially flush with an outer sleeve 256 to a second extended position shown in FIG. 7B where at least a portion of each cutter 252 and 254 extend outwardly from the sleeve 256. This lateral movement of the side cutters 252 and 254 is actuated by rotational movement of the upper cam member 258 relative to the lower cam member 260. The upper cam member 258 is rigidly mounted to the inner sleeve 262, as with a set screw 263 while the lower cam member 260 abuts against the proximal end 264 of the sleeve 262 but can freely rotate relative to the inner sleeve 262 and the upper cam member 258. This allows the upper cam member 258 to be rotated relative to the lower cam member 258 from a first position in which the cutting elements 252 and 254 are in a retracted state to a second position, as shown in FIG. 7B, in which the cutting elements 252 and 254 are fully extended. Reversing the direction of the drill to which the adapter 250 is attached will reverse the movement of the cutting elements 252 and 254. As the lower cam member 260 is rotated in a clockwise direction, the base portions of the cutting elements 252 and 254 that engage corresponding grooves in the lower cam member slide along the grooves. The upper cam member 258 is provided with recesses that allow for lateral movement of the cutting elements 252 and 254 relative thereto, but that prevents any substantial movement of the cutting elements 252 and 254 in a rotational direction relative to the upper cam member 258. In essence, the upper cam member 258 forms an abutment to prevent rotational movement of the cutting elements 252 and 254 relative to the upper cam member 258 while allowing the cam members to move laterally. The outer sleeve 254 is retained on the outer perimeter surfaces of the upper and lower cam members 258 and 260 by the engagement of the cutting elements 252 and 254.

Figure 8B:
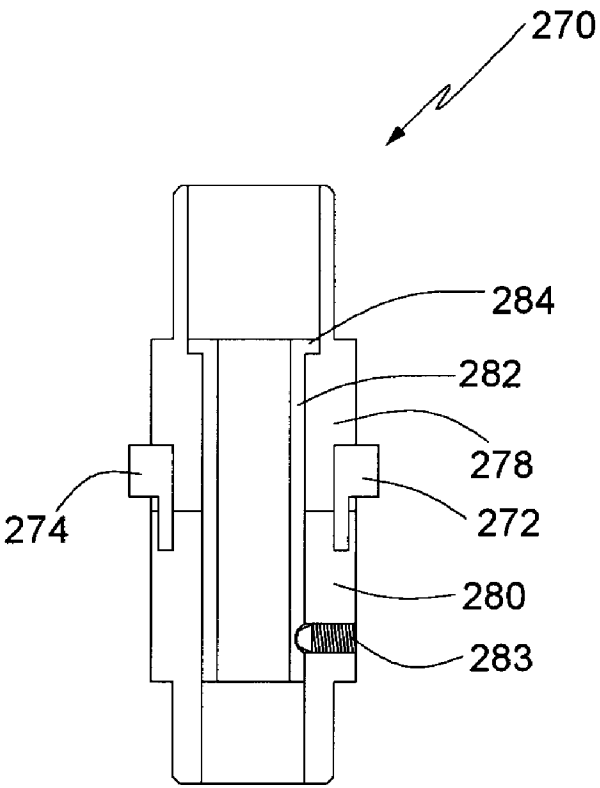
FIGS. 8A and 8B are cross-sectional side views of yet another embodiment of a side cutting adapter in accordance with the principles of the present invention.
Figure 8A:
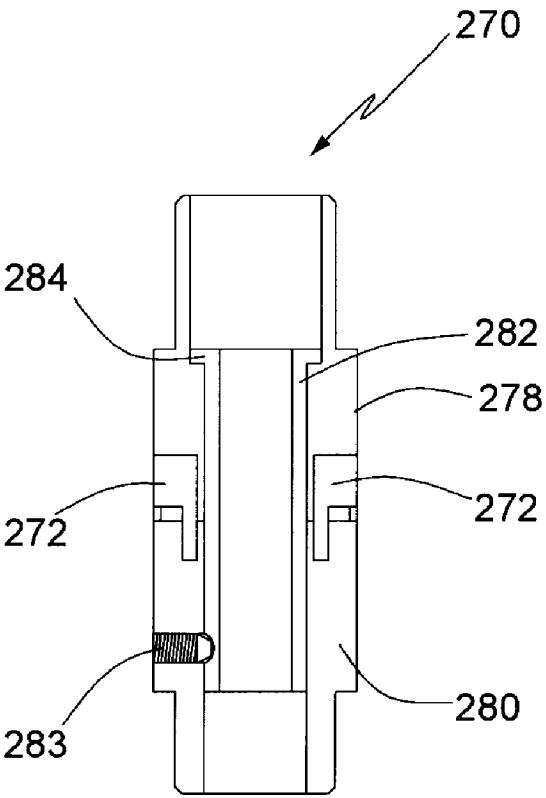

As shown in FIGS. 8A and 8B, a side cutting bit adapter, generally indicated at 270, is capable of extending and retracting laterally extendable side cutters 272 and 274 from a retracted position shown in FIG. 8A to a second extended position shown in FIG. 8B where at least a portion of each cutter 252 and 254 extend outwardly from the upper cam member 278. This lateral movement of the side cutters 272 and 274 is actuated by rotational movement of the upper cam member 278 relative to the lower cam member 280. The lower cam member 280 is fixedly mounted to the inner sleeve 282, as with a set screw 283 while the upper cam member 278 abuts against the end 284 of the sleeve 282 and can freely rotate relative to the inner sleeve 282 and the upper lower member 280. This allows the upper cam member 278 to be rotated relative to the lower cam member 280 from a first position in which the cutting elements 272 and 274 are in a retracted state to a second position, as shown in FIG. 8B, in which the cutting elements 272 and 274 are fully extended. Reversing the direction of the drill to which the adapter 270 is attached will reverse the movement of the cutting elements 272 and 274. As the lower cam member 280 is rotated in a clockwise direction, the base portions of the cutting elements 272 and 274 that engage corresponding grooves in the lower cam member slide along the grooves. The upper cam member 278 is provided with recesses that allow for lateral movement of the cutting elements 272 and 274 relative thereto, but that prevents any substantial movement of the cutting elements 272 and 274 in a rotational direction relative to the upper cam member 258. The cutting portions of the cutting elements 272 and 274 are housed within the upper cam member 278, which also prevents rotational movement of the cutting elements 272 and 274 relative to the upper cam member 278 while allowing the cam members to move laterally outward.

Figure 9B:
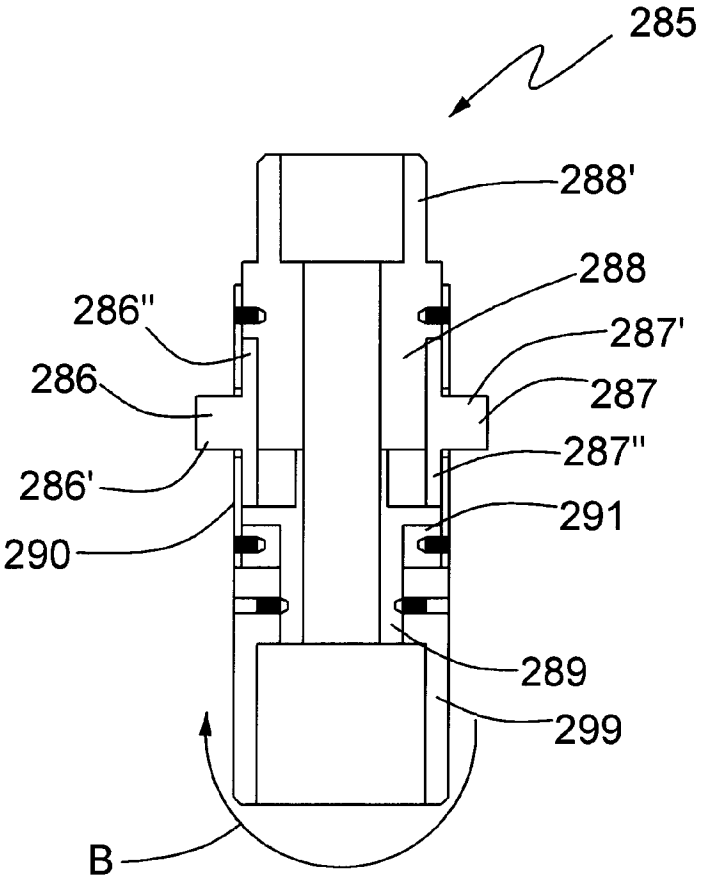
FIGS. 9A and 9B are cross-sectional side views of still another embodiment of a side cutting adapter in accordance with the principles of the present invention.
Figure 9A:
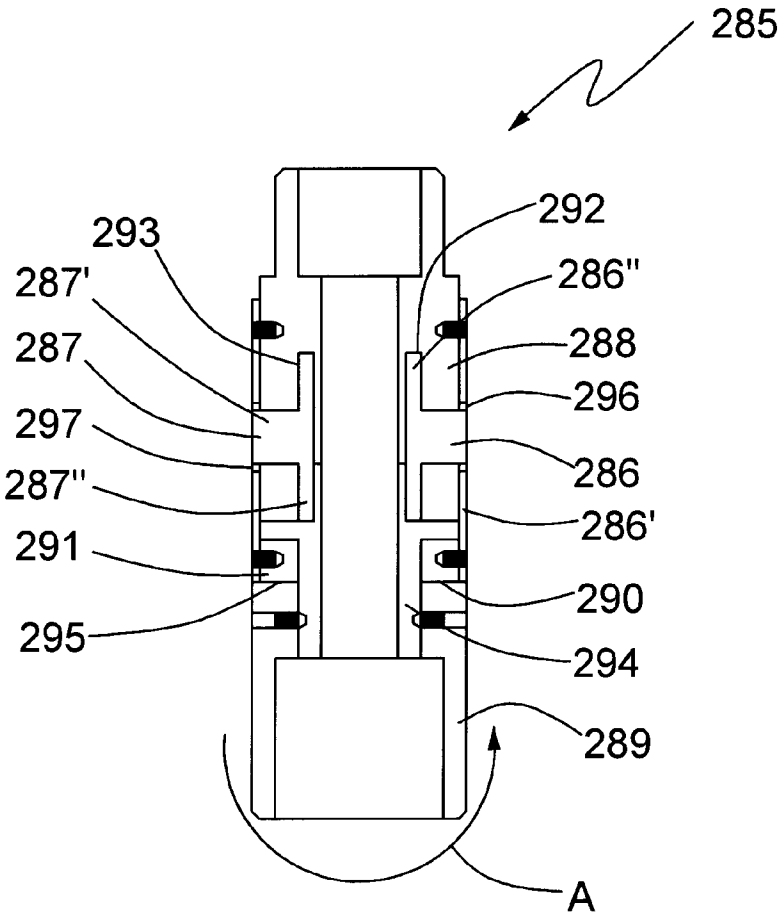

As shown in FIGS. 9A and 9B, a side cutting bit adapter, generally indicated at 285, is capable of extending and retracting laterally extendable side cutters 286 and 287 from a retracted position shown in FIG. 9A to a second extended position shown in FIG. 9B where at least a portion of each cutter 286 and 287 extend outwardly from an upper cutter guide member 288. This lateral movement of the side cutters 286 and 287 is actuated by rotational movement of the upper guide member 288 relative to a lower cutter guide member 289. The lower guide member 289 is rotatably coupled to the upper guide member 288 with outer sleeve 290. Outer sleeve 290 is fixedly coupled to the upper guide member 288, as with threaded fasteners, and rotatably coupled to the lower guide member 289 as with ring bearing 291 to which is fixedly attached. The ring bearing 291 may be of a ball bearing or surface bearing type. The ring bearing 291 abuts against the lower guide member 289 and holds it against the upper guide member 288 while allowing the lower guide member 289 to rotate relative to the upper guide member 288. The sleeve 290 includes apertures, which may be lined with bearing surfaces 296 and 297 for receiving and retaining the cutting portions 286' and 297' of the side cutters. The upper guide member 288 is provided with cutter base guiding grooves 292 and 293 that circumferentially extend from an inner radius to an outer radius of the upper guide member 288. The lower guide member 289 is provided with cutter base guide slots 294 and 295 that radially extend from an inner radius to an outer radius in the lower guide member 289. The base portions 286" and 287" of the cutters 286 and 287 are held within the guide slots 294 and 295 and will move to a full inward position when the lower guide member 289 is rotated relative to the upper guide member 288 in the direction of arrow A. Conversely, the base portions 286" and 287" of the cutters 286 and 287 will move to an outward position as shown in FIG. 9B, when the lower guide member 289 is rotated relative to the upper guide member 288 in the direction of arrow B so as to cause the cutting portion 286' and 287' to protrude from the outer sleeve 290. The upper guide member 288 is provided with an attachment portion 288' configured for attachment to a drill bit (as previously described and shown herein) and the lower guide member 289 is fixedly coupled to a drill stem coupler 299 with the drill stem coupler 299 configured for attachment to the distal end of a drill stem (as previously described and shown herein). It should be noted that while the various components are shown as being coupled together with various fastening mechanisms, such as the set screws shown in FIGS. 9A and 9B, other means of attachment may be employed including welding and/or compression fitting. In addition, while some components are illustrated as being formed from separate components that are fixedly coupled, such components could be combined and formed from a single integral component. For example, the outer sleeve 290 and upper guide member 288, outer sleeve 290 and ring bearing 291, and/or lower guide member 289 and drill stem coupler 299 could be integrally formed. Likewise, various components that are shown to be formed from a single integral component could be formed from multiple components that are combined to form a similar structure. As such, reference herein to the term "member" or "structure" is not intended to limit such components or parts to singular integrated components or parts, but could be formed from multiple combined components or parts.

Figures 10A, 10B, 10C, 10D:
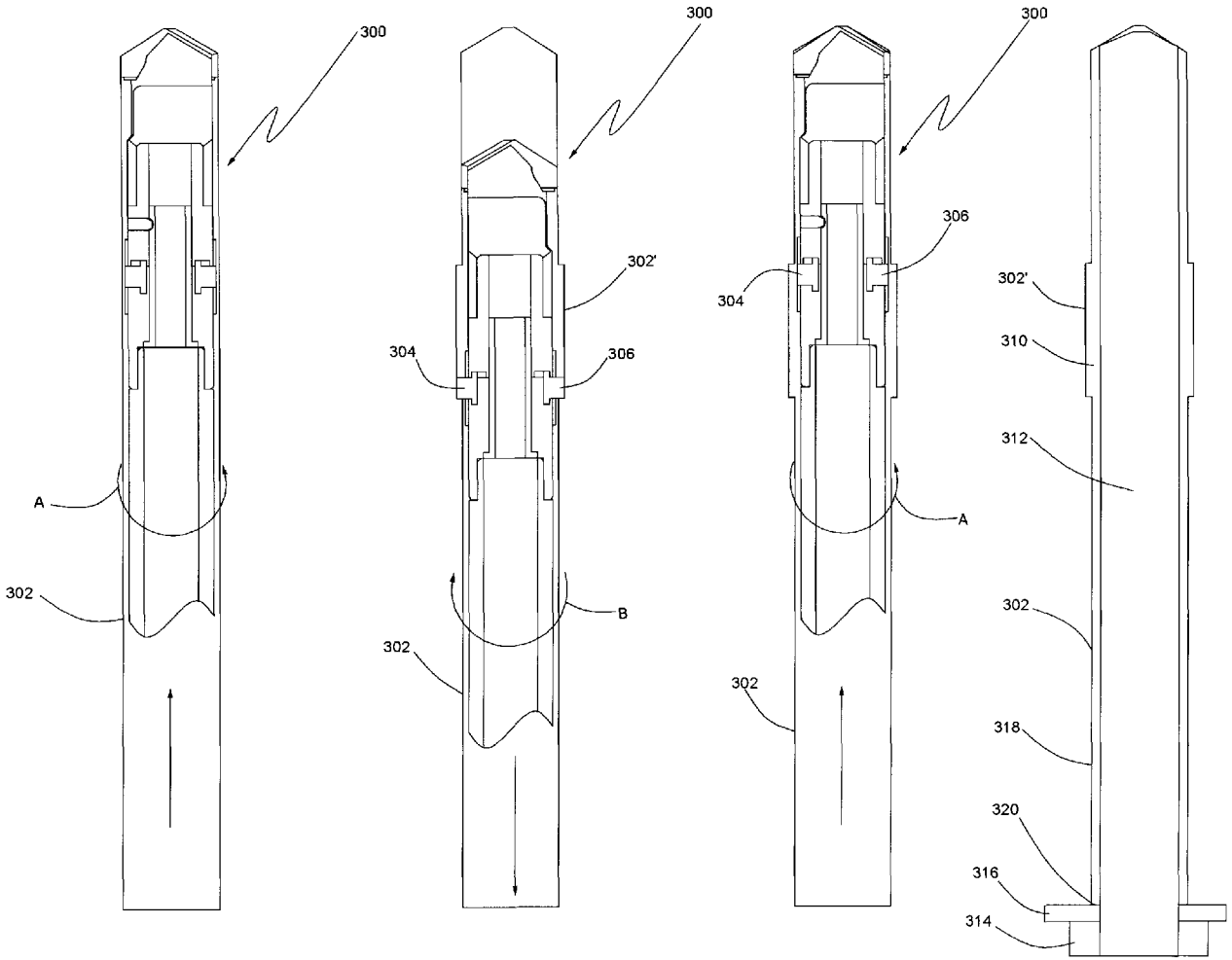
FIGS. 10A, 10B, 10C and 10D are cross-sectional side views of a drill string in accordance with the principles of the present invention in various stages of cutting a borehole according the methods of the present invention.

FIGS. 10A-10D illustrate a process for producing a borehole in an earthen formation having a portion therein with a wider diameter than a portion closer to the exit opening of the borehole. As shown in FIG. 10A, a drill bit assembly, generally indicated at 300, is used to drill a borehole 302 by rotating the drill bit as indicated by arrow A until a desired borehole depth is reached. In this step, the drill bit assembly operates as any other drill bit assembly known in the art for forming a borehole. Once the desired borehole depth is reached, the direction of rotation of the drill bit assembly 300 is reversed as indicated by arrow B as shown in FIG. 10B. After less than a half of a rotation of the drill bit assembly 300, the cutting elements 304 and 306 become fully laterally extended. Continued high speed counter-rotation and partial extraction of the drill bit assembly 300 causes the cutting elements 304 and 306 to engage and cut the side walls of the borehole 302 to create an enlarged diameter section 302'. After a sufficient desired length of the borehole 302 has been widened, as shown in FIG. 10C, the drill bit assembly 300 is again fully reinserted into the borehole 300 and the direction of rotation of the drill bit assembly 300 is once again reversed to be in the direction of arrow A, which causes the cutting elements 304 and 306 to retract. Once retracted, the entire dill string can be removed from the borehole 302. The resulting borehole 302 as shown in FIG. 10D is provided with an enlarged diameter section 302' (shown for illustration purposes to be relatively short in length) that could run a substantial length of the borehole 302. When the resin 310 and roof bolt 312 are inserted into the borehole 302, the resin at least partially fills the enlarged diameter section 302' and bonds to the roof bolt 312. As such, the roof bolt 312 can be tensioned by tightening the head 314 of the bolt 312 against a roof plate 316 (shown to be smaller in scale than is actually the case for illustrative purposes), even in soft or highly fragmented rock formations since the enlarged area of resin is extremely difficult to remove through the remaining smaller diameter portion 318 of the borehole 302 that is nearer the opening 320 of the borehole 302. This makes it virtually impossible for the roof bolt 312 to become dislodged from the borehole 302 resulting in a significantly more stable roof bolt installation and ultimately safer underground mine shafts.

While not specifically illustrated herein, the present invention will have other applications where it is desirable to secure an anchoring system of some design into an earthen borehole. Thus, while the present invention has been described with reference to certain illustrative embodiments to illustrate what is believed to be the best mode of the invention, it is contemplated that upon review of the present invention, those of skill in the art will appreciate that various modifications, combinations and other adaptations may be made to the present embodiments without departing from the spirit and scope of the invention as recited in the claims. It should be noted that reference to the terms "ground anchor" or "anchoring system" in the specification and claims is intended to cover all types of devices used attach to or to secure or retain earthen formations, without limitation. Indeed, as discussed the drilling apparatus of the present invention may have particular utility in many different applications where it is desirable to secure an object into a hole drilled into a rock, cement or other hard formation. The claims provided herein are intended to cover such modifications, adaptations and combinations and all equivalents thereof. Reference herein to specific details of the illustrated embodiments is by way of example and not by way of limitation.

What is claimed is:

1. An apparatus for forming a borehole in an earthen formation, comprising:

a drill bit having a distal cutting end and a proximal end configured for coupling;

a side cutting apparatus comprising;

a first end configured for coupling to the drill bit and a second end configured for coupling to a drill stern;

a first cam structure having at least one groove formed therein, the at least one groove being laterally radially offset relative to the first cam structure;

at least one cutting element having a base portion disposed at least partially within the at least one groove and a cutting portion depending from the base portion and radially extending from the first cam structure;

a second cam structure positioned adjacent the first cam structure for retaining the at least one cutting element within the at least one groove;

a sleeve rotatably coupled to one of the first cam structure and the second cam structure and fixedly coupled to the other of the first cam structure and the second cam structure; and an outer sleeve positioned over at least one of the first cam structure and the second cam structure and having at least one aperture formed in a side wall thereof, the cutting portion of the cutting element extending through the aperture at least when in the second extended position;

whereby rotation of the drilling stem in a first direction causes the at least one cutting element to be in a first retracted position relative to the sleeve and rotation of the drilling stem in a second direction causes the first cam structure to rotate relative to the second cam structure to thereby force the at least one cutting element to move along the at least one groove to a second extended position.

2. The apparatus of claim 1, wherein the first cam assembly includes a pair of grooves, each groove being laterally radially offset relative to the first cam structure and in an opposite direction to the other groove.

3. The apparatus of claim 1, wherein the base portion of the at least one cutting element is selected from the group consisting of a pin, an arcuate plate or a semispherical ball.

4. The apparatus of claim 1, wherein the second cam structure defines at least one recess in a face thereof that faces the first cam structure, at least a portion of the base portion of the at least one cutting element positioned within the recess, the recess having a width substantially similar to a width of the base portion inserted therein and a length sufficient to allow the base portion to translate within the at least one recess as the base portion moves along the at least one groove.

5. The apparatus of claim 1, wherein the first and second cam structures are in a fixed relation to each other and wherein the second cam structure includes at least one corresponding groove to the at least one groove and wherein the outer sleeve is fixedly coupled relative to one of the first cam structure and the second cam structure so as to rotate therewith.

6. The apparatus of claim 1, wherein the outer sleeve is integrally formed with the first cam structure and the second cam structure fits at least partially within the outer sleeve.

7. An apparatus for forming a borehole in an earthen formation, comprising:

a side cutting assembly comprising;

a first end configured for coupling to a drill bit and a second end configured for coupling to a drill stem;

a first cam structure having at least one groove formed therein, the at least one groove being laterally radially offset relative to the first cam structure;

at least one cutting element having a base portion disposed at least partially within the at least one groove and a cutting portion depending from the base portion and radially extending from the first cam structure;

a second cam structure positioned adjacent the first cam structure for retaining the at least one cutting element within the at least one groove; and a sleeve rotatably coupled to one of the first cam structure and the second cam structure and fixedly coupled to the other of the first cam structure and the second cam structure, the sleeve comprising an outer sleeve positioned over at least one of the first cam structure and the second cam structure and having at least one aperture formed in a side wall thereof, the cutting portion of the cutting element extending through the aperture at least when in the second extended position;

whereby rotation of a drilling stem in a first direction causes the at least one cutting element to be in a first retracted position relative to the first cam structure and rotation of the drilling stem in a second direction causes the first cam structure to rotate relative to the second cam structure to thereby forcing the at least one cutting element to move along the at least one groove to a second extended position.

8. The apparatus of claim 7, wherein the first cam assembly includes a pair of grooves, each groove being laterally radially offset relative to the first cam structure and in an opposite direction to the other groove.

9. The apparatus of claim 7, wherein the base portion of the at least one cutting element is selected from the group consisting of pin, an arcuate plate or a semispherical ball.

10. The apparatus of claim 7, wherein the second cam structure defines at least one recess in a face thereof that faces the first cam structure, at least a portion of the base portion of the at least one cutting element positioned within the recess, the recess having a width substantially similar to a width of the base portion inserted therein and a length sufficient to allow the base portion to translate within the at least one recess as the base portion moves along the at least one groove.

11. The apparatus of claim 10, wherein the face of the second cam structure abuts against the first cam structure.

12. The apparatus of claim 7, wherein the first and second cam structures are in a fixed relation to each other and wherein the second cam structure includes at least one corresponding groove to the at least one groove and wherein the outer sleeve is fixedly coupled relative to one of the first cam structure and the second cam structure so as to rotate therewith.

13. The apparatus of claim 7, wherein the outer sleeve is integrally formed with the first cam structure and the second cam structure fits at least partially within the outer sleeve.

14. A method for forming a borehole in an earthen formation, comprising:

providing a drill bit assembly, comprising:

a drill bit having a distal cutting end and a proximal end configured for coupling;

a side cutting apparatus comprising;

a first end configured for coupling to the drill bit and a second end configured for coupling to a drill stem;

a first cam structure having at least one groove formed therein, the at least one groove being laterally radially offset relative to the first cam structure;

at least one cutting element having a base portion disposed at least partially within the at least one groove and a cutting portion depending from the base portion and radially extending from the first cam structure;

a second cam structure positioned adjacent the first cam structure for retaining the at least one cutting element within the at least one groove; and a sleeve rotatably coupled to one of the first cam structure and the second cam structure and fixedly coupled to the other of the first cam structure and the second cam structure;

rotating the drill bit assembly in a first direction to drill a borehole in an earthen formation with the at least one cutting element in a first retracted position;

rotating the drill bit assembly in a second direction to the first cam structure to rotate relative to the second cam structure to thereby forcing the at least one cutting element to move along the at least one groove to a second extended position;

retracting the drill bit assembly from the borehole a certain distance to form an enlarge borehole portion in a down hole location;

rotating the drill bit assembly in the first direction to cause the at least one cutting element to retract to the first retracted position; and removing the drill bit assembly from the borehole.

15. The method of claim 14, further comprising providing the first cam assembly with a pair of grooves, each groove being laterally radially offset relative to the first cam structure and in an opposite direction to the other groove.

16. The method of claim 14, further comprising providing the base portion of the at least one cutting element selected from the croup consisting of a pin, an arcuate plate or a semispherical ball.

17. The method of claim 14, further comprising providing the second cam structure with at least one recess in a face thereof that faces the first cam structure, at least a portion of the base portion of the at least one cutting element positioned within the recess, the recess having a width substantially similar to a width of the base portion inserted therein and a length sufficient to allow the base portion to translate within the at least one recess as the base portion moves along the at least one groove.

18. The method of claim 14, further comprising providing an outer sleeve positioned over at least one of the first cam structure and the second cam structure and having at least one aperture formed in a side wall thereof, the cutting portion of the cutting element extending through the aperture at least when in the second extended position.

19. The method of claim 18, further comprising providing the first and second cam structures in a fixed relation to each other and wherein the second cam structure includes at least one corresponding groove to the at least one groove and wherein the outer sleeve is fixedly coupled relative to one of the first cam structure and the second cam structure so as to rotate therewith.

* * * * *